US010882077B2

(12) United States Patent
Yang et al.

(10) Patent No.: US 10,882,077 B2
(45) Date of Patent: Jan. 5, 2021

(54) CLEANING APPARATUS AND CLEANING METHOD

(71) Applicants: BOE TECHNOLOGY GROUP CO., LTD., Beijing (CN); ORDOS YUANSHENG OPTOELECTRONICS CO., LTD., Inner Mongolia (CN)

(72) Inventors: Le Yang, Beijing (CN); Fashun Li, Beijing (CN)

(73) Assignees: BOE TECHNOLOGY GROUP CO., LTD., Beijing (CN); ORDOS YUANSHENG OPTOELECTRONICS, Inner Mongolia (CN)

( * ) Notice: Subject to any disclaimer, the term of this patent is extended or adjusted under 35 U.S.C. 154(b) by 419 days.

(21) Appl. No.: 15/735,407

(22) PCT Filed: Jun. 9, 2017

(86) PCT No.: PCT/CN2017/087681
§ 371 (c)(1),
(2) Date: Dec. 11, 2017

(87) PCT Pub. No.: WO2018/152983
PCT Pub. Date: Aug. 30, 2018

(65) Prior Publication Data
US 2020/0130020 A1 Apr. 30, 2020

(51) Int. Cl.
*B08B 1/00* (2006.01)
*B05B 1/02* (2006.01)
(Continued)

(52) U.S. Cl.
CPC ..... *B08B 1/006* (2013.01); *B05B 1/02* (2013.01); *B05B 1/20* (2013.01); *B08B 3/024* (2013.01); *B08B 3/08* (2013.01); *B05B 12/006* (2013.01)

(58) Field of Classification Search
CPC B08B 1/006; B08B 3/024; B08B 3/08; B05B 1/02; B05B 1/20; B05B 12/006
(Continued)

(56) References Cited

U.S. PATENT DOCUMENTS 7,918,347 B2 4/2011 Geisbauer
8,458,826 B2 6/2013 Mock et al.

FOREIGN PATENT DOCUMENTS

CN 101316970 A 12/2008
CN 101351254 A 1/2009
(Continued)

OTHER PUBLICATIONS

CN104228335A—Machine translation (Year: 2014).*
(Continued)

*Primary Examiner* — Tinsae B Ayalew
(74) *Attorney, Agent, or Firm* — Nath, Goldberg & Meyer; Joshua B. Goldberg

(57) ABSTRACT

The present application provides a cleaning apparatus and a cleaning method. The cleaning apparatus includes two wiping parts opposite to each other, a connection part and a cleanliness detection device. The two wiping parts defines a space therebetween to accommodate a part to be cleaned. The two wiping parts are connected through the connection part. The cleanliness detection device is configured to detect cleanliness of the part to be cleaned. The connection part is configured to control a distance between the two wiping parts based on the detected cleanliness.

13 Claims, 5 Drawing Sheets

(51) Int. Cl.

| | |
|---|---|
| ***B05B 1/20*** | (2006.01) |
| ***B08B 3/02*** | (2006.01) |
| ***B08B 3/08*** | (2006.01) |
| *B05B 12/00* | (2018.01) |

(58) Field of Classification Search
USPC ..... 134/198
See application file for complete search history.

(56) References Cited

FOREIGN PATENT DOCUMENTS

| | | | | |
|---|---|---|---|---|
| CN | 201863487 | U | | 6/2011 |
| CN | 202016262 | U | | 10/2011 |
| CN | 101351254 | B | | 1/2012 |
| CN | 101316970 | B | | 4/2012 |
| CN | 104228335 | A | * | 12/2014 |
| CN | 104228335 | A | | 12/2014 |
| CN | 104589793 | A | | 5/2015 |
| CN | 204774070 | U | * | 11/2015 |
| CN | 204774070 | U | | 11/2015 |
| CN | 205308584 | U | | 6/2016 |
| CN | 106079893 | A | | 11/2016 |
| JP | 2000-141592 | A | | 5/2000 |
| JP | 2001-38886 | A | | 2/2001 |

OTHER PUBLICATIONS

CN204774070U—Machine translation (Year: 2015).*
CN205308584U—Machine translation (Year: 2016).*
JP2000141592A—Machine translation (Year: 2000).*
International Search Report dated Sep. 14, 2017 in corresponding International Application No. PCT/CN2017/087691 along with an English translation of the International Search Report and an English translation of the Written Opinion of the International Searching Authority.
First Office Action dated Nov. 16, 2017 in corresponding Chinese Patent Application No. 201610438996.3.

* cited by examiner

CLEANING APPARATUS AND CLEANING METHOD

CROSS-REFERENCE TO RELATED APPLICATIONS

This is a National Phase Application filed under 35 U.S.C. 371 as a national stage of PCT/CN2017/087691, filed Jun. 9, 2017, an application claiming the benefit of Chinese Patent Application No. 201610438996.3, filed on Jun. 17, 2016, the contents of which are incorporated by reference in the entirety.

FIELD

The present disclosure relates to the field of cleaning technologies for printing apparatuses, and particularly to a cleaning apparatus and a cleaning method.

BACKGROUND

Currently, organic light emitting diode (OLED) devices are mainly encapsulated by glass frit. The glass frit is printed on a cover glass for OLEDs primarily through a screen printing apparatus, and then the cover glass and an evaporated glass are adhered together.

SUMMARY

An embodiment of the present disclosure provides a cleaning apparatus including two wiping parts opposite to each other, a connection part and a cleanliness detection device, the two wiping parts defining a space therebetween to accommodate a part to be cleaned, and the two wiping parts being connected through the connection part, wherein the cleanliness detection device is configured to detect cleanliness of the part to be cleaned; and the connection part is configured to control a distance between the two wiping parts based on the detected cleanliness.

Optionally, the wiping part is of a plate shape, and the cleaning apparatus further includes a driving part configured to control the wiping part to move in a plane where the wiping part is located, and wherein a pressure sensor is provided on the wiping part as the cleanliness detection device, connected with the driving part, and configured to sense a pressure in a wiping process;

In a case where the pressure for a position sensed by the pressure sensor is larger than a predetermined threshold value, the driving part is configured to control the wiping part to wipe the sensed position; and in a case where the pressure for a position sensed by the pressure sensor is smaller than or equal to the predetermined threshold value, the driving part is configured to control the wiping parts to move away from each other.

Optionally, at least a part of an inner wall of the connection part is provided with a spray unit configured to spray a cleanser towards opposite surfaces of the two wiping parts, respectively.

Optionally, the cleaning apparatus further includes a cleaning cloth provided on each of the opposite surfaces of the two wiping parts.

Optionally, the spray unit includes a plurality of nozzles spaced apart from each other, and spraying zones of adjacent ones of the plurality of nozzles have an overlapped region.

Optionally, the spraying zone of the nozzle is of a circular shape, and spaces between the nozzles are set such that a half of an area of a spraying zone of one of the plurality nozzles is overlapped with a half of an area of a spraying zone of an adjacent one of the plurality nozzles.

An embodiment of the present disclosure further provides a cleaning method by using the above described cleaning apparatus, and the method includes steps of: placing a part to be cleaned in a space defined between the two wiping parts; driving, through the connection part, the two wiping parts to move towards each other to be in contact with the part to be cleaned; detecting, through the cleanliness detection device, cleanliness of the part to be cleaned; and controlling the wiping parts to move based on the detected cleanliness, thereby wiping the part to be cleaned.

Optionally, at least a part of an inner wall of the connection part is provided with a spray unit, and the cleaning method further includes a step of spraying, by using the spray unit, a cleanser towards opposite surfaces of the two wiping parts, respectively.

Optionally, the cleaning apparatus further includes a cleaning cloth provided on each of the opposite surfaces of the two wiping parts, and the cleaning method further includes steps of: pre-wiping the part to be cleaned by using the cleaning cloth before the cleanser is sprayed towards the opposite surfaces of the two wiping parts by using the spray unit; and wiping the part to be cleaned by using the cleaning cloth after the cleanser is sprayed towards the opposite surfaces of the two wiping parts by using the spray unit.

Optionally, the cleaning apparatus further includes a cleaning cloth provided on each of the opposite surfaces of the two wiping parts, and the cleaning method further includes a step of: spraying a cleanser towards opposite surfaces of the two wiping parts by using the spray unit, while wiping the part to be cleaned by using the cleaning cloth.

Optionally, the spray unit includes a plurality of nozzles spaced apart from each other, and spraying zones of adjacent ones of the plurality of nozzles have an overlapped region.

Optionally, the wiping part is of a plate shape and the cleaning apparatus further includes a driving part, and the method further includes a step of controlling, through the driving part, the wiping part to move in a plane where the wiping part is located.

Optionally, a pressure sensor is provided on the wiping part as the cleanliness detection device, connected with the driving part, and configured to sense a pressure in a wiping process; and the cleaning method further includes steps of: sensing, by using the pressure sensor, a pressure in the wiping process; in a case where the pressure for a position sensed by the pressure sensor is larger than a predetermined threshold value, controlling, through the driving part, the wiping part to wipe the sensed position; and in a case where the pressure for a position sensed by the pressure sensor is smaller than or equal to the predetermined threshold value, controlling, through the driving part, the wiping parts to move away from each other.

Optionally, the cleaning method further includes a step of causing the two wiping parts to move away from each other so as to be separated from the part to be cleaned.

DETAILED DESCRIPTION

To make those skilled in the art better understand the technical solutions of the present disclosure, the present disclosure will be further described below in detail in conjunction with the accompanying drawings and specific implementations.

Currently, organic light emitting diode (OLED) devices are mainly encapsulated by glass frit. The glass frit is printed on a cover glass for OLEDs primarily through a screen printing apparatus, and then the cover glass and an evaporated glass are adhered together.

In the existing art, when a scraper (or squeegee) of a screen printing apparatus is cleaned, a residual glass frit on the scraper is manually scrapped off by a scraping knife or the like, which easily leads to a damage to the edge of the scraper. The damaged scraper is liable to cause a large amount of defective products in the glass-frit-encapsulation process, thereby severely affecting product yield.

Accordingly, the present disclosure provides, inter alia, a cleaning apparatus and a cleaning method that substantially obviate one or more of the problems due to limitations and disadvantages of the related art.

Figure 1:
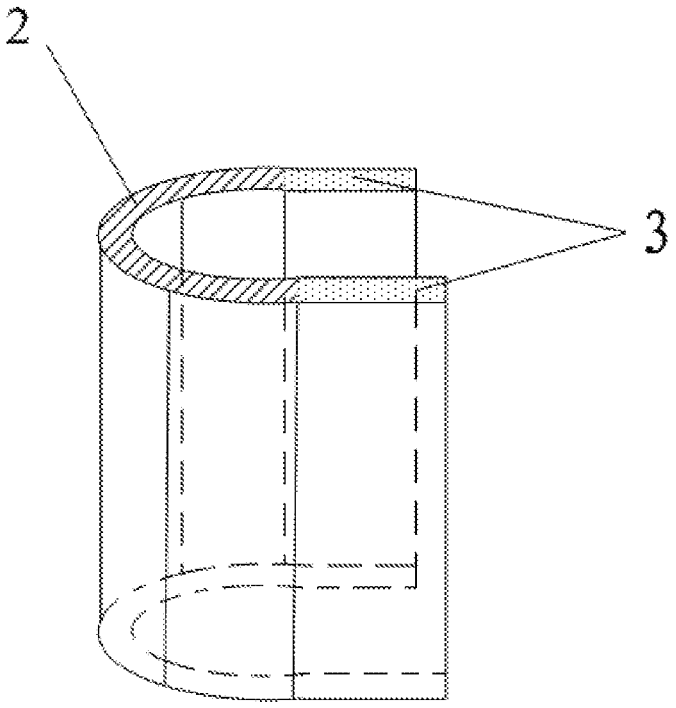
FIG. 1 is a schematic diagram illustrating a structure of a cleaning apparatus according to a first embodiment of the present disclosure.

A first embodiment of the present disclosure provides a cleaning apparatus. As shown in FIG. 1, the cleaning apparatus includes two wiping parts 3 opposite to each other, and the two wiping parts 3 define a space therebetween to accommodate a part to be cleaned. The two wiping parts 3 are connected through a connection part 2. The connection part 2 is configured to drive the two wiping parts 3 to move towards each other or away from each other.

In the cleaning apparatus provided by the present embodiment, the two wiping parts 3 are connected through the connection part 2, which can adjust the two wiping parts 3 to move towards each other or away from each other. That is, a distance between the two wiping parts 3 can be adjusted by the connection part 2. When the present cleaning apparatus is employed to clean a scraper (an example of a part to be cleaned) of a screen printing apparatus, the cleaning apparatus moves to a position where the scraper is located, and at this time, the two wiping parts 3 connected through the connection part are positioned close to the scraper. Then, the connection part 2 is adjusted so that the two wiping parts 3 move towards each other to be in contact with the scraper, and then glass frit on the scraper can be removed by the wiping parts 3 by controlling the wiping parts 3 to move back and forth along a length direction of the scraper. After the removal is completed, the connection part 2 is adjusted so that the two wiping parts 3 move away from each other, thereby being separated from the scraper. The present cleaning apparatus is easy to use. Further, the distance between the two wiping parts 3 can be adjusted through the connection part 2, and thus the present cleaning apparatus is suitable for cleaning various types of scrapers or squeegees.

Figure 2:
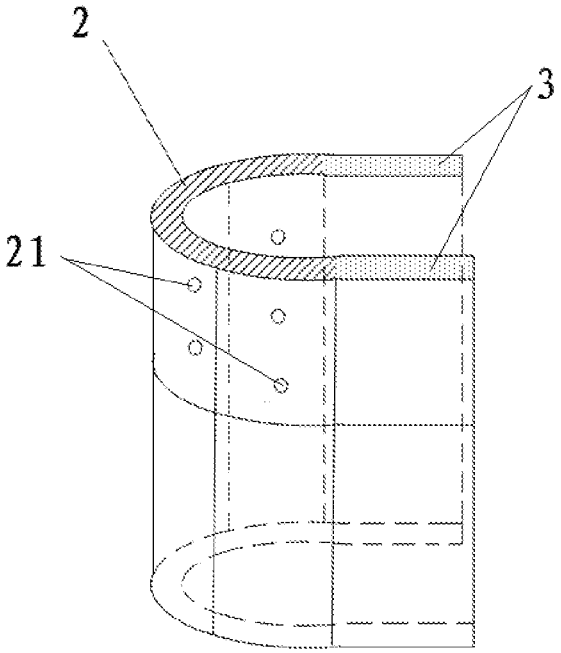
FIG. 2 is a schematic diagram illustrating a structure of a cleaning apparatus according to a second embodiment of the present disclosure.

A second embodiment of the present disclosure provides a cleaning apparatus, as shown in FIG. 2. The cleaning apparatus includes two wiping parts 3 opposite to each other, and opposite ends of the two wiping parts 3 are connected through a connection part 2, which is deformable so that the two wiping parts 3 may move towards each other or away from each other. At least a part of an inner wall of the connection part 2 is provided with a plurality of spray units configured to spray a cleanser towards opposite surfaces of the two wiping parts 3, respectively.

The wiping parts 3 of the cleaning apparatus in FIG. 2 are two plate-shaped structures opposite to each other. However, it can be understood that when the wiping parts 3 are used for wiping a scraper having a relatively small size, the two wiping parts 3 opposite to each other may be two strip-shaped structures opposite to each other. In this case, the connection part 2 also connects corresponding ends of the two strip-shaped wiping parts 3. FIG. 2 illustrates an example of the connection part 2, which is of an arc shape. It can be understood that the arc-shaped connection part 2 can be elastically deformed.

In the present embodiment, an upper portion of the inner wall of the connection part 2 is provided with the plurality of spray units configured to spray a cleanser. The cleanser herein may include a cleanser capable of dissolving glass frit on the scraper, such as organic cleanser, solvent, etc. As indicated by dotted arrows in FIG. 7, which will be described later, a direction in which a cleanser is sprayed is different for each spray unit. The directions in which the cleanser is sprayed correspond to the two wiping parts 3, respectively. In the present embodiment, the spray unit is optionally provided on the upper portion of the inner wall of the connection part 2, so that a portion of the sprayed cleanser flows downwards to the lower portions of the opposite surfaces of the two wiping parts 3 due to the gravity effect, thereby avoiding waste of the cleanser.

Figure 3:
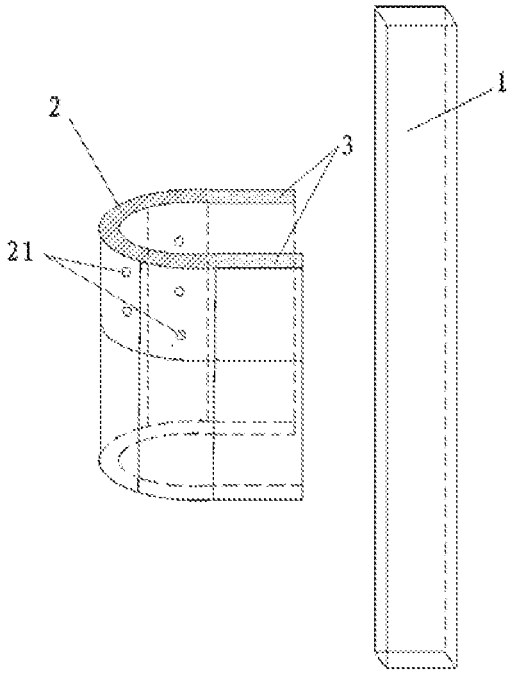
FIGS. 3 and 4 illustrate an exemplary process of cleaning a part to be cleaned by using the cleaning apparatus according to the second embodiment of the present disclosure.
Figure 4:
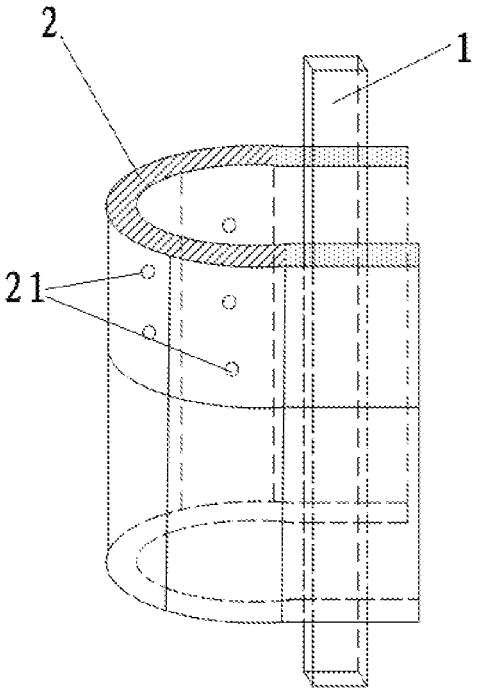

FIGS. 3 and 4 illustrate an exemplary process of cleaning a part to be cleaned by using the cleaning apparatus according to the second embodiment of the present disclosure. As shown in FIG. 3, when the present cleaning apparatus is employed to clean a scraper 1 of a screen printing apparatus, the cleaning apparatus moves to a position where the scraper 1 is located, and at this time, the two wiping parts 3 connected through the connection part 2 are positioned close to the scraper 1. As shown in FIG. 4, the connection part 2 that is elastic is adjusted so that the two wiping parts 3 move towards each other to be in contact with the scraper 1, and then glass frit on the scraper 1 can be removed by the wiping parts 3 by controlling the wiping parts 3 to move back and forth along a length direction of the scraper 1. When the wiping parts 3 move back and forth along the length direction of the scraper 1, the spray units may be controlled at the same time to spray a cleanser on the wiping parts 3, so as to remove stubborn glass frit. After the removal is completed, the elastic connection part 2 may be adjusted so that the two wiping parts 3 move away from each other, thereby being separated from the scraper 1. The present cleaning apparatus is easy to use. Further, the distance between the two wiping parts 3 can be adjusted through the elastic connection part 2, and thus the present cleaning apparatus is suitable for cleaning various types of scrapers or squeegees.

Optionally, the spray units include a plurality of nozzles spaced apart from each other, and spraying zones of adjacent ones of the plurality of nozzles have an overlapped region.

Optionally, the spraying zone of the nozzle is of a circular shape, and spaces between the nozzles are set such that a half of an area of a spraying zone of one of the plurality nozzles is overlapped with a half of an area of a spraying zone of an adjacent one of the plurality nozzles.

Optionally, a distance between adjacent nozzles is set to be a half of a diameter of the maximum spraying zone.

Figure 5:
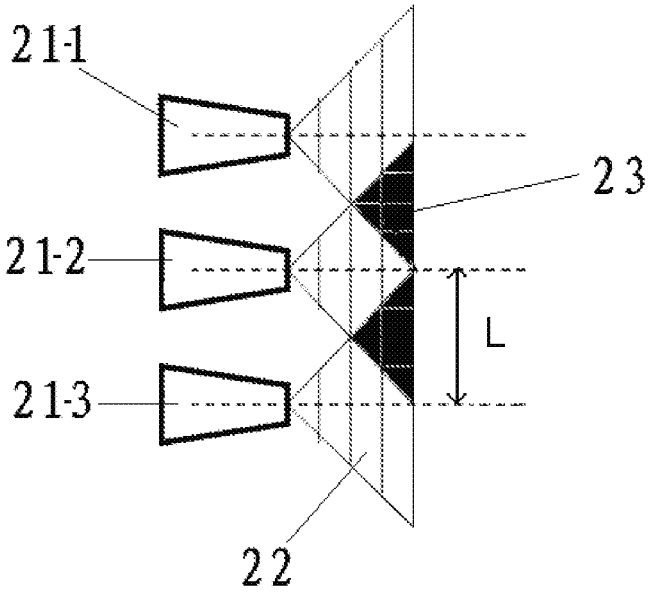
FIG. 5 is a schematic diagram illustrating spraying zones according to the second embodiment of the present disclosure.

FIG. 5 is a schematic diagram illustrating spraying zones according to the second embodiment of the present disclosure. As shown in FIG. 5, the cleanser is sprayed from the nozzles 21, and an area covered by the spraying zone 22 is of a circular shape. A center of the circular area corresponding to the nozzle 21 (i.e., a center of the sprayed cleanser) is subjected to the maximum spraying pressure, and the closer to the periphery of the circular area, the smaller spraying pressure it is subjected to. As the spraying zones of adjacent nozzles 21 have an overlapped region 23, the spraying pressure of the sprayed cleaner at the periphery of one spraying zone can be greatly enhanced, thereby improving cleaning effect. Specifically, as shown in FIG. 5, three nozzles 21 of a first nozzle 21-1, a second nozzle 21-2 and a third nozzle 21-3 are arranged sequentially from top to bottom, such that a half of an area covered by the cleanser sprayed from the first nozzle 21-1 is overlapped with a half of an area covered by the cleanser sprayed from the second nozzle 21-1. That is, a distance L between the nozzles 21 are set such that a half of an area of a spraying zone of one nozzle is overlapped with a half of an area of a spraying zone of an (each) adjacent nozzle, thereby enhancing the pressure of the sprayed cleanser at the periphery of one spraying zone.

Optionally, a cleaning cloth is provided on each of the opposite surfaces of the two wiping parts, and the spray unit may spray a cleanser to the cleaning cloth. The cleaning cloth is made of a soft material such that the scraper may not be damaged by the cleaning cloth. Further, the cleaning cloth can absorb the cleanser, thereby further preventing the cleanser from being wasted due to the gravity effect. It can be understood that the cleaning cloth, after being used for a long time and being damaged, can be replaced by a new one. Optionally, the cleaning cloth may be made of a nano-scaled material.

Optionally, the cleaning apparatus further includes a driving part configured to control the wiping part to move in a plane where the wiping part is located.

Optionally, a pressure sensor (an example of the cleanliness detection device) is provided on the wiping part, connected with the driving part, and configured to sense a pressure in a wiping process; in a case where the pressure for a position sensed by the pressure sensor is larger than a predetermined threshold value, the driving part is configured to control the wiping part to wipe the sensed position; and in a case where the pressure for a position sensed by the pressure sensor is smaller than or equal to the predetermined threshold value, the driving part is configured to control the wiping parts to move away from each other.

Figure 6:
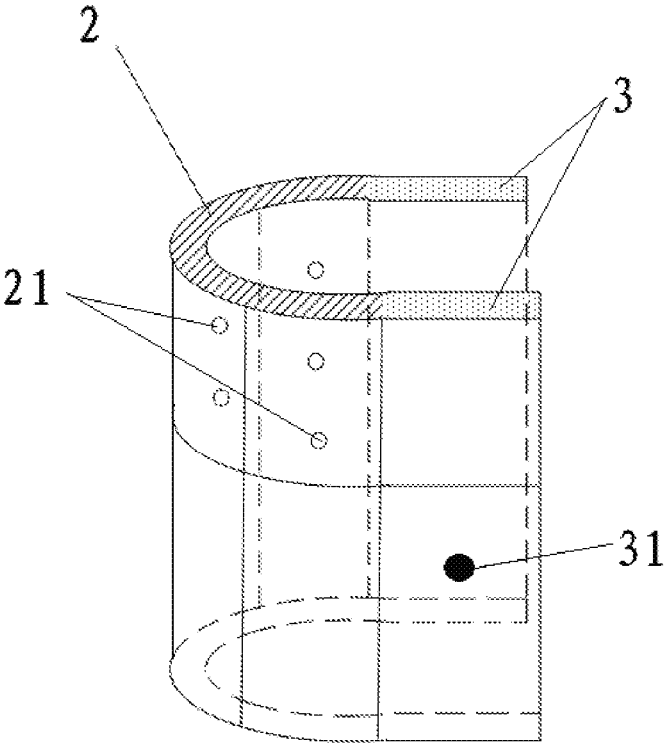
FIG. 6 is a schematic diagram illustrating a structure of the cleaning apparatus according to the second embodiment of the present disclosure.
Figure 7:
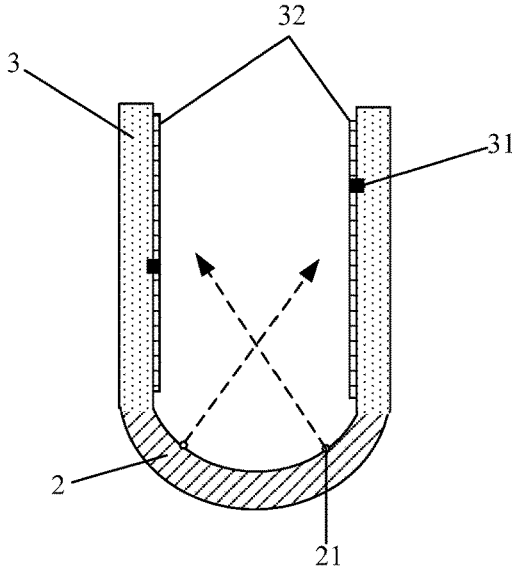
FIG. 7 is a schematic diagram illustrating a structure of the cleaning apparatus according to the second embodiment of the present disclosure, in which each nozzle sprays a cleanser in a different direction.

FIGS. 6 and 7 illustrate a structure of the cleaning apparatus according to the second embodiment of the present disclosure, and FIG. 7 further illustrates that a direction in which the cleanser is sprayed from different nozzles, as mentioned above. As shown in FIGS. 6 and 7, a pressure sensor 31 is provided on the wiping part 3. As shown in FIG. 7, cleaning clothes 32 are provided on opposite surfaces of the two wiping parts 3, respectively. Optionally, the pressure sensor 31 may be provided between the wiping part 3 and the cleaning cloth 32. Optionally, the pressure sensor 31 may be provided on a surface of the cleaning cloth 32. Taking a case where the pressure sensor 31 is provided on the surface of the cleaning cloth 32 as an example, the driving part initially drives the cleaning cloth 32 to be in contact with the edge of the scraper 1 to which the residual glass frit is adhered, and then the cleaning apparatus moves relative to the scraper 1 along a length direction of the scraper 1, thereby wiping the scraper 1. The driving part is configured to drive the wiping part 3 to move in a plane where the wiping part 3 is located, such that surfaces of the wiping part 3 and the scraper 1 rub each other, thereby further achieving automatically cleaning.

In the relative movement of the wiping process, a pressure value 'n' sensed by the pressure sensor 31 is continuously fed back to the driving part. In the present embodiment, a threshold value 'm', as a reference value (or reference range) obtained when a cleaning cloth is in contact with a clean scraper, indicates a pressure when the clean scraper is in contact with the cleaning cloth 32. It should be noted that the threshold value 'm' may be a preset value or a value with an allowable error range. In this case, a distance between the two opposite cleaning clothes 32 may be considered as a reference distance for the threshold value 'm'. Optionally, 'm' may be set to be 0. Optionally, 'm' may be set to be slightly larger than 0. Needless to say, the value of 'm' is not limited thereto, and 'm' may be set to be any appropriate value. In a case when 'n' for a position on the scraper is larger than 'm', it can conclude that the position is not clean, and the cleaning cloth 32 may be controlled to move to the position and perform a wiping process. During the wiping process, 'n' will be gradually decreased. It can be understood that the driving part can drive the cleaning cloth 32 to be in contact with and clean the scraper 1 having a glass frit thereon multiple times. If there is a residual glass frit on the scraper, 'n' will be decreased by the cleaning. When 'n' is equal to or smaller than 'm' for the reference distance, it indicates that the position where the residual glass frit is located has been cleaned up, and the cleaning cloth 32 is separated from the scraper 1. It can be understood that for cleaning different scrapers 1, the threshold value 'm' of the pressure when the scraper 1 is in contact with the cleaning cloth 32 may be set based on sizes, types and the like of the scrapers 1.

Optionally, a section of a combination of the two wiping parts and the connection part taken along a plane orthogonal to the wiping part is of a U-like shape.

As shown in FIG. 7, a section of a combination of the two wiping parts 3 and the connection part 2 taken along a plane orthogonal to the wiping part 3 is configured to be a U-like shape, thereby facilitating arrangement of the spray units on the bottom of the U-like shape.

Figure 8:
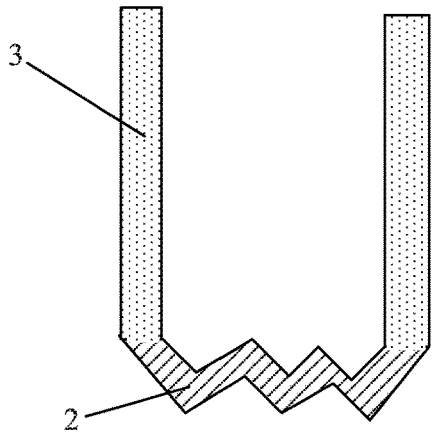
FIG. 8 illustrates an example of a structure of a connection part of the cleaning apparatus according to the second embodiment of the present disclosure.
Figure 9:
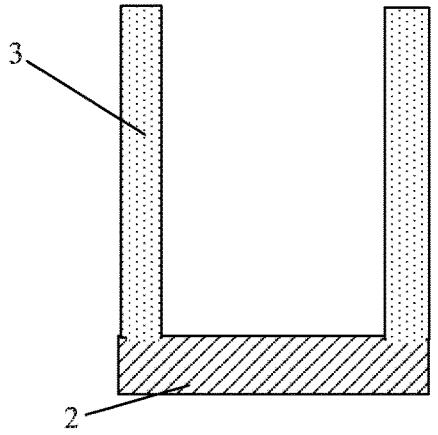
FIG. 9 illustrates another example of a structure of the connection part of the cleaning apparatus according to the second embodiment of the present disclosure.

It can be understood that the section of the combination of the two wiping parts and the connection part taken along a plane orthogonal to the wiping part may be of any other shapes, such as the shapes shown in FIGS. 8 and 9.

Optionally, the wiping part is connected with the connection part through a screw.

That is, the two wiping parts 3 of the cleaning apparatus provided by the present embodiment are detachable. Therefore, when the cleaning apparatus is used for cleaning the scraper 1 having a different type, it only needs to replace the wiping parts with ones having a corresponding size, thereby achieving the versatility of the cleaning apparatus, and effectively reducing the cost of modification or replacement of the cleaning apparatus when being used for different parts to be cleaned.

Needless to say, specific implementations of the above embodiments can be varied in many ways. For example, the specific arrangement positions or the number of the spray units can be modified based on the specific type of the scraper. For another example, the spray unit may be connected with containers containing different types of solutions, and thus which one of the solutions should be sprayed and/or an amount of the sprayed solution can be adjusted depending on actual needs.

Figure 10:
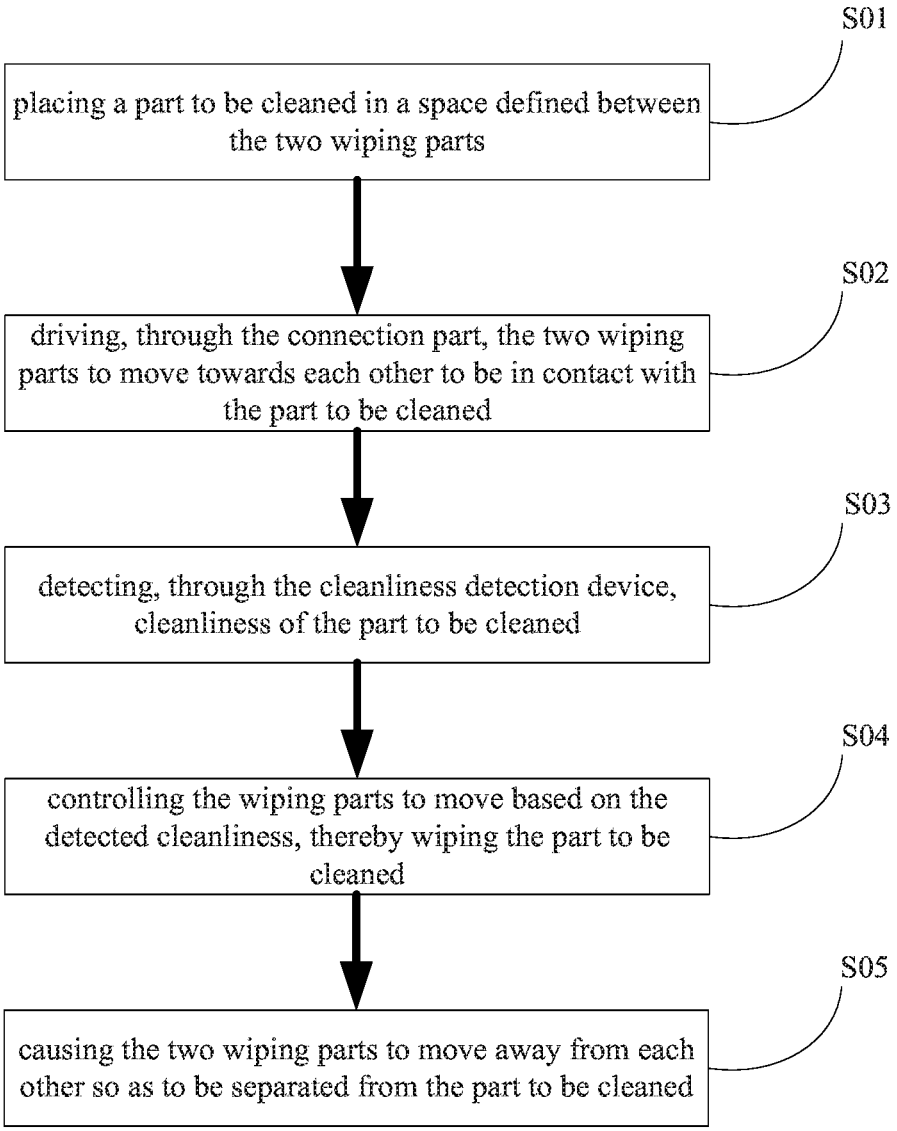
FIG. 10 illustrates a flow chart of a cleaning method according to a third embodiment of the present disclosure.

A third embodiment of the present disclosure provides a cleaning method by using the above cleaning apparatus provided by the above embodiments. As shown in FIG. 10, the method includes the following steps of:

S01, placing a part to be cleaned in a space defined between the two wiping parts;

S02, driving, through the connection part, the two wiping parts to move towards each other to be in contact with the part to be cleaned;

S03, detecting, through the cleanliness detection device, cleanliness of the part to be cleaned; and

S04, controlling the wiping parts to move based on the detected cleanliness, thereby wiping the part to be cleaned.

Optionally, the cleaning method further includes a step of spraying, by using the spray unit, a cleanser towards opposite surfaces of the two wiping parts, respectively.

Optionally, the cleaning method further includes steps of pre-wiping the part to be cleaned by using the cleaning cloth before the cleanser is sprayed towards opposite surfaces of the two wiping parts by using the spray unit; and wiping the part to be cleaned by using the cleaning cloth after a cleanser is sprayed towards opposite surfaces of the two wiping parts by using the spray unit. A better cleaning effect can be achieved through the two-step process of pre-wiping and wiping. Needless to say, the cleaning method of the present disclosure is not limited thereto. For example, the spray unit may clean (i.e., pre-clean) the part to be cleaned in a surrounding manner at first, and then the cleaning cloth is used to wipe the part to be cleaned. For another example, in order to save the cleaning time, it is possible to wipe the part to be cleaned by using the cleaning cloth while spraying the cleanser towards the opposite surfaces of the two wiping parts by using the spraying unit.

Optionally, the cleaning method further includes a step of controlling, through the driving part, the wiping part to move in a plane where the wiping part is located.

Optionally, the cleaning method further includes steps of sensing, by using the pressure sensor, a pressure in the wiping process; in a case where the pressure for a position sensed by the pressure sensor is larger than a predetermined threshold value, controlling, through the driving part, the wiping part to wipe the sensed position; and in a case where the pressure for a position sensed by the pressure sensor is smaller than or equal to the predetermined threshold value, controlling, through the driving part, the wiping parts to move away from each other.

Optionally, the method further includes a step S05 of causing the two wiping parts to move away from each other so as to be separated from the part to be cleaned. To this end, the cleaning is completed.

The cleaning method of the present embodiment is easy to operate, has a good applicability, and is suitable for fast line production in manufacturing process.

It should be understood that the steps of the above method can be performed in a sequential order or not in a sequential order, provided that there is no conflict. In other cases, a plurality of steps may be performed in parallel. It should also be understood that not all the illustrated steps need to be performed. One or more of the steps may not be performed, or additional one or more steps may be performed.

It can be understood that the foregoing implementations are merely exemplary implementations used for describing the principle of the present disclosure, but the present disclosure is not limited thereto. Those ordinary skilled in the art may make various variations and improvements without departing from the spirit and essence of the present disclosure, and these variations and improvements shall fall into the protection scope of the present disclosure.

What is claimed is:

1. A cleaning apparatus, comprising two wiping parts opposite to each other, a connection part and a cleanliness detection device, the two wiping parts defining a space therebetween to accommodate a part to be cleaned, and the two wiping parts being connected through the connection part, wherein the cleanliness detection device is configured to detect cleanliness of the part to be cleaned; and the connection part is configured to control a distance between the two wiping parts based on the detected cleanliness, wherein a wiping part of the two wiping pails is of a plate shape, and the cleaning apparatus further comprises a driving par configured to control the wiping part to move in a plane where the wiping part is located, and wherein a pressure sensor is provided on the wiping part as the cleanliness detection device, connected with the driving part, and configured to sense a pressure in a wiping process;

in a case where the pressure for a position of the part to be cleaned sensed by the pressure sensor is larger than a predetermined threshold value, the driving part is configured to control the wiping part to wipe the sensed position; and in a case where the pressure for a position of the part to be cleaned sensed by the pressure sensor is smaller than or equal to the predetermined threshold value, the driving part is configured to control the wiping parts to move away from each other.

2. The cleaning apparatus of claim 1, wherein at least a part of an inner wall of the connection part is provided with a spray unit configured to spray a cleanser towards opposite surfaces of the two wiping parts, respectively.

3. The cleaning apparatus of claim 2, further comprising a cleaning cloth provided on each of the opposite surfaces of the two wiping parts.

4. The cleaning apparatus of claim 2, wherein the spray unit comprises a plurality of nozzles spaced apart from each other, and spraying zones of adjacent ones of the plurality of nozzles have an overlapped region.

5. The cleaning apparatus of claim 4, wherein the spraying zone of the nozzle is of a circular shape, and spaces between the nozzles are set such that a half of an area of a spraying zone of one of the plurality nozzles is overlapped with a half of an area of a spraying zone of an adjacent one of the plurality nozzles.

6. A cleaning method using a cleaning apparatus, wherein the cleaning apparatus is the cleaning apparatus of claim 1, and the method comprises steps of:

placing a part to be cleaned in a space defined between the two wiping parts;

driving, through the connection part, the two wiping parts to move towards each other to be in contact with the part to be cleaned;

detecting, through the cleanliness detection device, cleanliness of the part to be cleaned; and controlling the wiping parts to move based on the detected cleanliness, thereby wiping the part to be cleaned.

7. The cleaning method of claim 6, wherein at least a part of an inner wall of the connection part is provided with a spray unit, and the cleaning method further comprises a step of spraying, by using the spray unit, a cleanser towards opposite surfaces of the two wiping parts, respectively.

8. The cleaning method of claim 7, wherein the cleaning apparatus further comprises a cleaning cloth provided on each of the opposite surfaces of the two wiping parts; and the cleaning method further comprises steps of:

pre-wiping the part to be cleaned by using the cleaning cloth before the cleanser is sprayed towards the opposite surfaces of the two wiping parts by using the spray unit; and wiping the part to be cleaned by using the cleaning cloth after the cleanser is sprayed towards the opposite surfaces of the two wiping parts by using the spray unit.

9. The cleaning method of claim 7, wherein the cleaning apparatus further comprises a cleaning cloth provided on each of the opposite surfaces of the two wiping parts; and the cleaning method further comprises a step of:

spraying a cleanser towards the opposite surfaces of the two wiping parts by using the spray unit, while wiping the part to be cleaned by using the cleaning cloth.

10. The cleaning method of claim 7, wherein the spray unit comprises a plurality of nozzles spaced apart from each other, and spraying zones of adjacent ones of the plurality of nozzles have an overlapped region.

11. The cleaning method of claim 6, wherein the wiping part is of a plate shape and the cleaning apparatus further comprises a driving part; and the method further comprises a step of controlling, through the driving part, the wiping part to move in a plane where the wiping part is located.

12. The cleaning method of claim 11, wherein a pressure sensor is provided on the wiping part as the cleanliness detection device, connected with the driving part, and configured to sense a pressure in a wiping process; and the cleaning method further comprises steps of:

sensing, by using the pressure sensor, a pressure in the wiping process;

in a case where the pressure for a position sensed by the pressure sensor is larger than a predetermined threshold value, controlling, through the driving part, the wiping part to wipe the sensed position; and in a case where the pressure for a position sensed by the pressure sensor is smaller than or equal to the predetermined threshold value, controlling, through the driving part, the wiping parts to move away from each other.

13. The cleaning method of claim 6, further comprising a step of causing the two wiping parts to move away from each other so as to be separated from the part to be cleaned.

* * * * *